US010128624B2

(12) United States Patent
Tyler et al.

(10) Patent No.: US 10,128,624 B2
(45) Date of Patent: Nov. 13, 2018

(54) POWER CONNECTOR SYSTEM

(71) Applicant: TE CONNECTIVITY CORPORATION, Berwyn, PA (US)

(72) Inventors: Adam Price Tyler, Rochester Hills, MI (US); Aric J. Boyer, Troy, MI (US); David James Rhein, Memphis, MI (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/661,853

(22) Filed: Jul. 27, 2017

(65) Prior Publication Data

US 2018/0034219 A1 Feb. 1, 2018

Related U.S. Application Data

(60) Provisional application No. 62/369,455, filed on Aug. 1, 2016.

(51) Int. Cl.

| | |
|---|---|
| ***H01R 13/11*** | (2006.01) |
| ***H01R 13/44*** | (2006.01) |
| ***H01R 24/76*** | (2011.01) |
| ***H01R 13/447*** | (2006.01) |
| ***H01R 13/629*** | (2006.01) |
| ***H01R 24/28*** | (2011.01) |

(52) U.S. Cl.

CPC ..... *H01R 24/76* (2013.01); *H01R 13/112* (2013.01); *H01R 13/113* (2013.01); *H01R 13/44* (2013.01); *H01R 13/447* (2013.01); *H01R 13/62938* (2013.01); *H01R 24/28* (2013.01); *H01R 2201/26* (2013.01)

(58) Field of Classification Search

CPC ... H01R 24/76; H01R 24/28; H01R 13/62938
See application file for complete search history.

(56) References Cited

U.S. PATENT DOCUMENTS

| | | | | |
|---|---|---|---|---|
| 4,423,917 | A | 1/1984 | Scheingold et al. | |
| 2009/0246996 | A1 | 10/2009 | Ogata et al. | |
| 2012/0156909 | A1* | 6/2012 | Tyler | H01R 13/112 439/259 |
| 2016/0064849 | A1 | 3/2016 | Eckel | |

FOREIGN PATENT DOCUMENTS

| | | | |
|---|---|---|---|
| WO | 2012082162 | A1 | 6/2012 |
| WO | 2014187908 | A1 | 11/2014 |

OTHER PUBLICATIONS

International Search Report, International Application No. PCT/IB2017/054630, International Filing Date Jul. 28, 2017.

* cited by examiner

*Primary Examiner* — Briggitte R Hammond

(57) ABSTRACT

A power connector system includes a header connector having a header housing mounted to a chassis. The header housing holds a header terminal comprising a plurality of contact members arranged side-by-side in a stacked arrangement. Each contact member has a pair of spring beams defining sockets at a mating end of the contact member. The sockets of the contact members are aligned to define a tab socket of the header terminal. The power connector system includes a plug connector having a plug housing holding a tab terminal. The tab terminal has a mating end and a cable end. The mating end is received in a mating direction into the tab socket of the header terminal during mating to electrically connect the tab terminal with the header terminal.

20 Claims, 5 Drawing Sheets

POWER CONNECTOR SYSTEM

CROSS-REFERENCE TO RELATED APPLICATIONS

This application claims priority to U.S. Provisional Application No. 62/369,455, filed 1 Aug. 2016, titled "POWER CONNECTOR SYSTEM", which is incorporated by reference herein in its entirety.

BACKGROUND OF THE INVENTION

The subject matter herein relates generally to plug connectors for power connector systems.

Power terminals are used to make a power connection between components in high power applications, such as in electric or hybrid electric vehicles between the battery and other components, such as the electric motor, the inverter, the charger, and the like. However, due to the high power requirements, the electrical connectors typically house many contacts to increase the current capacity of the circuits. Having many contact points leads to high connector mating forces. Known power terminals designed with many contact points are complex to form and assemble, which may require substantial tooling capital, increasing the overall cost of manufacturing the power terminals. Furthermore, known power terminals designed with many contact points are typically large, making it difficult to make finger proof touch-safe, which may be required in particular applications, such as automotive applications.

A need remains for a power connector system having a high power connection that is compact, simple to tool and/or can be made touch-safe.

BRIEF DESCRIPTION OF THE INVENTION

In one embodiment, a power connector system is provided including a header connector having a header housing mounted to a chassis. The header housing holds a header terminal comprising a plurality of contact members arranged side-by-side in a stacked arrangement. Each contact member has a pair of spring beams defining a socket at a mating end of the contact member. The sockets of the contact members are aligned to define a tab socket of the header terminal. The power connector system includes a plug connector having a plug housing holding a tab terminal. The tab terminal has a mating end and a cable end. The mating end is received in a mating direction into the tab socket of the header terminal during mating to electrically connect the tab terminal with the header terminal.

In another embodiment, a power connector system is provided including a header connector and a plug connector. The header connector includes a header housing mounted to a chassis. The header housing defines a header chamber. The header housing holds a plurality of contact members in the header chamber. The contact members are arranged side-by-side in a stacked arrangement to define a header terminal. The contact members each have a pair of spring beams defining a socket at a mating end of the respective contact member. The sockets of the contact members being aligned to define a tab socket of the header terminal. The header connector includes a header touch guard around the header terminal. The header touch guard has openings that provide mating access to the header terminal but are touch-safe. The plug connector has a plug housing defining a plug chamber. The plug housing has a mating end and a cable end with a power cable extending from the cable end. The plug connector holds a tab terminal in the plug chamber. The tab terminal has a mating end received in a mating direction into the tab socket of the header terminal during mating to electrically connect the tab terminal with each of the contact members in the header terminal. The tab terminal has a cable end that is terminated to the power cable. The plug connector has a plug touch guard at the mating end of the plug housing that provides mating access to the tab terminal but is touch-safe.

In a further embodiment, a power connector system is provided including a header connector and a plug connector. The header connector includes a header housing mounted to a chassis. The header housing holds a plurality of contact members arranged side-by-side in a stacked arrangement to define a header terminal. The contact members are double ended fork contacts having pairs of spring beams that define sockets at both a first mating end and a second mating end of the respective contact member. The sockets at the first mating ends of the contact members are aligned to define a tab socket of the header terminal. The sockets at the second mating ends of the contact members are aligned to define a bus bar socket of the header terminal configured to receive a bus bar therein. The plug connector has a plug housing holding a tab terminal. The plug housing has a mating end and a cable end with a power cable extending from the cable end. The tab terminal has a mating end received in a mating direction into the tab socket of the header terminal during mating to electrically connect the tab terminal with each of the contact members in the header terminal. The tab terminal has a cable end terminated to the power cable.

DETAILED DESCRIPTION OF THE INVENTION

Figure 1:
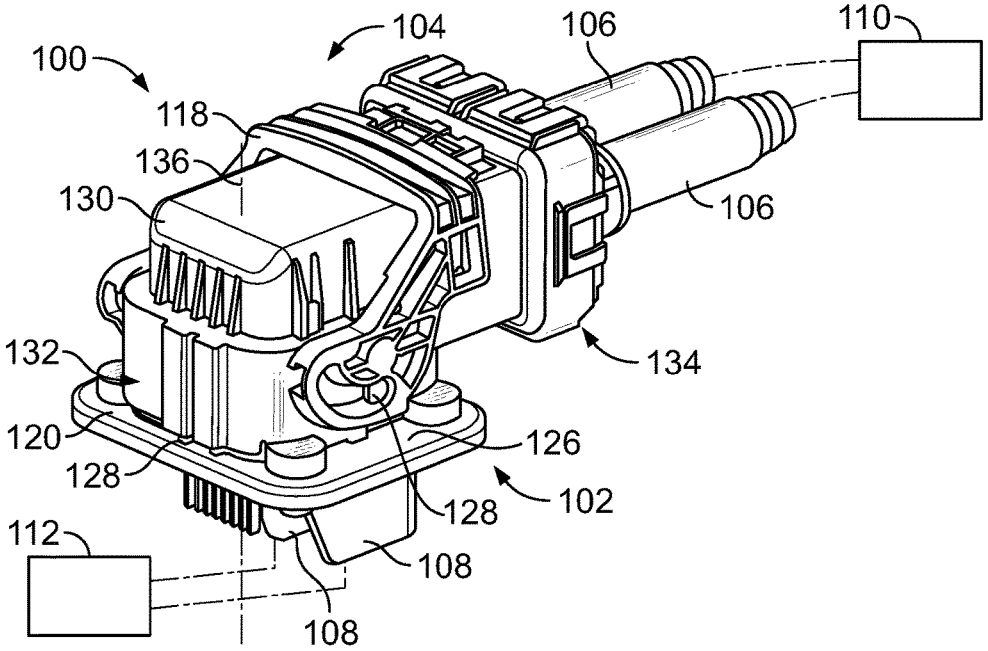
FIG. 1 is a perspective view of a power connector system formed in accordance with an exemplary embodiment with plug and header connectors thereof in an assembled and mated state.
Figure 2:
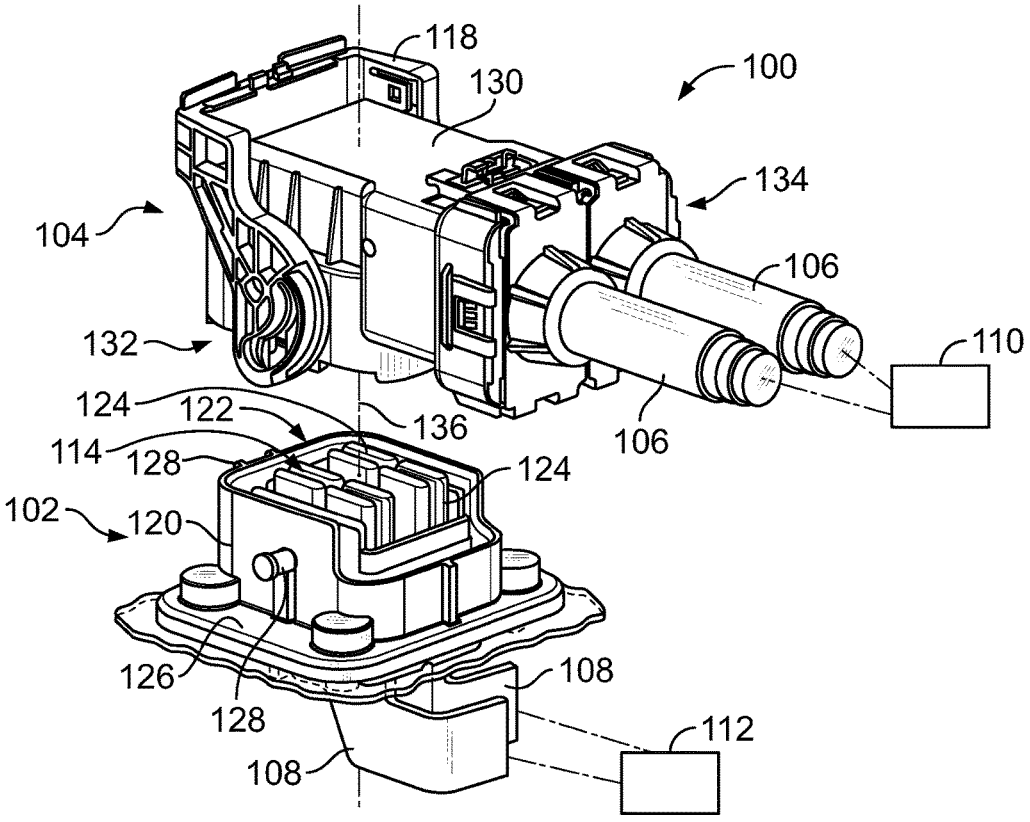
FIG. 2 is a perspective view of the power connector system with the plug and header connectors in an unmated state.

FIG. 1 is a perspective view of a power connector system 100 formed in accordance with an exemplary embodiment in an assembled and mated state. FIG. 2 is a perspective view of the power connector system 100 in an unmated state. The power connector system 100 includes a header connector 102 and a plug connector 104 configured to be mated with the header connector 102. In an exemplary embodiment, the power connector system 100 is a high power connector system that is used to transfer power between various components as part of a high power circuit. In a particular application, the power connector system 100 is a battery system, such as a battery system of a vehicle, such as an electric vehicle or hybrid electric vehicle; however the power connector system 100 is not intended to be limited to such battery systems.

The plug connector 104 is configured to be electrically connected to a component 110, such as through one or more power cables 106. For example, the plug connector 104 may be electrically connected to a battery, a charger, an inverter, an electric motor or another type of component. The header connector 102 is configured to be electrically connected to a component 112, such as through a power bus bar 108 (also referred to herein as power bus 108); however the header connector 102 may be electrically connected to the component 112 by other means, such as a terminal, power wire or other connector. For example, the header connector 102 may be electrically connected to a battery pack, such as through a battery distribution unit, a manual service disconnect, a charger, an inverter, an electric motor, or another type of component. The battery distribution unit may manage the power capacity and functionality of the power connector system 100, such as by measuring current and regulating power distribution of the battery pack.

The power connector system 100 is a right angle connector system where the connectors 102, 104 are mated in a direction perpendicular to the power wires. Optionally, the plug connector 104 may be removably coupled to the header connector 102 to disconnect the high power circuit of one or more of the components, such as the battery pack, the electric motor, the inverter, or other components of the vehicle, such as for maintenance, repair or for another reason. When mated, one or more header terminals 114 (FIG. 2) of the header connector 102 are mated with corresponding plug terminals 116 (shown in FIG. 3) of the plug connector 104, such as at mating interfaces thereof. Having a greater number of terminals 114 and/or 116 increases the current carrying capacity of the system 100. Optionally, each plug terminal 116 may be terminated to a corresponding power cable 106.

In an exemplary embodiment, the header connector 102 and/or the plug connector 104 may include a high voltage interlock (HVIL) circuit to control the high voltage power circuit during opening and closing or mating and unmating of the connectors 102, 104. For example, both connectors 102, 104 may include corresponding HVIL terminals. The HVIL circuit may be electrically connected to the component 112 and/or the component 110. In an exemplary embodiment, the plug connector 104 utilizes a lever 118 to unmate and/or mate the connectors 102, 104, which may open/close the high voltage circuit and the HVIL circuit during unmating/mating of the connectors 102, 104. The HVIL circuit may be opened first during unmating to shut of the high voltage circuit prior to opening or unmating of the terminals 116, 114, which may reduce the likelihood of damage, such as from arcing. In an exemplary embodiment, the high voltage conducting surfaces of the connectors 102, 104 are finger proof and touch-safe.

The header connector 102 includes a header housing 120 having a mating end 122. The header housing 120 holds one or more of the header terminals 114. Optionally, the header terminals 114 may be fork terminals having sockets defined by spring beams on both sides of the sockets to mate with both sides of the plug terminal 116, as described in further detail below; however, other types of header terminals may be used in alternative embodiments. The header terminals 114 may be shrouded to protect the header terminals 114. For example, the header terminals 114 may have covers or touch guards 124 such that the header terminals 114 are touch-safe. The header housing 120 includes a flange 126 for mounting the header housing 120 to another component, such as a chassis or other supporting structure. Optionally, the header housing 120 may be mounted horizontally; however, other orientations are possible in alternative embodiments. In an exemplary embodiment, the header housing 120 includes guide features 128 for guiding mating of the electrical connector 104 with the header connector 102. For example, the guide features 128 may be ribs, posts, slots, keying features or other types of guide features.

The plug connector 104 includes a plug housing 130 configured to be coupled to the header housing 120. The plug housing 130 includes a mating end 132 and a cable end 134. The power cables 106 extend from the cable end 134. The mating end 132 is mated to the mating end 122 of the header housing 120. In an exemplary embodiment, the housing 130 is a right angle housing holding the power cables 106 and the plug terminals 116 (shown in FIG. 3) perpendicular to a mating direction along a mating axis 136. The power cables 106 are at a right angle with respect to the mating axis 136. Other orientations are possible in alternative embodiments.

In an exemplary embodiment, the lever 118 is rotatably coupled to the housing 130. The lever 118 is configured to engage the header housing 120, such as corresponding guide features 128, to secure the plug connector 104 to the header connector 102. Optionally, the lever 118 may include a slot that receives corresponding guide features 128 to control mating and unmating of the plug connector 104 to the header connector 102. For example, as the lever 118 is rotated closed, the housing 130 may be pulled down onto the header housing 120. Conversely, as the lever 118 is raised, the housing 130 may be pressed away from and unmated from the header housing 120. The high power circuit and the HVIL circuit of the power connector system 100 may be opened and closed as the plug connector 104 is unmated from and mated to the header connector 102.

Figure 3:
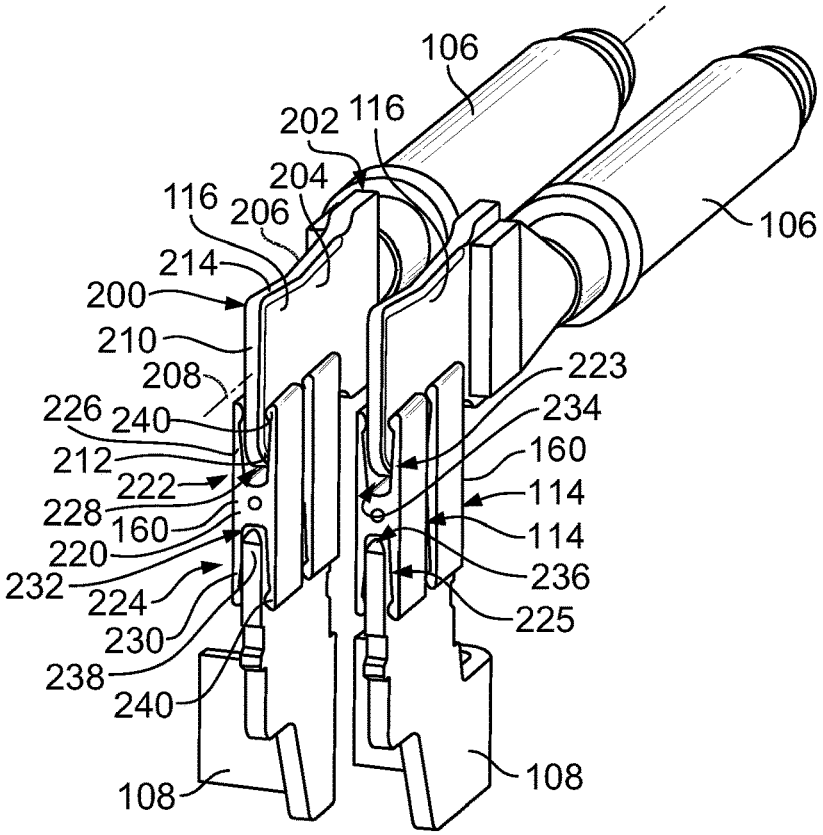
FIG. 3 is a perspective view of a portion of the power connector system showing plug terminals and header terminals of the connectors.
Figure 4:
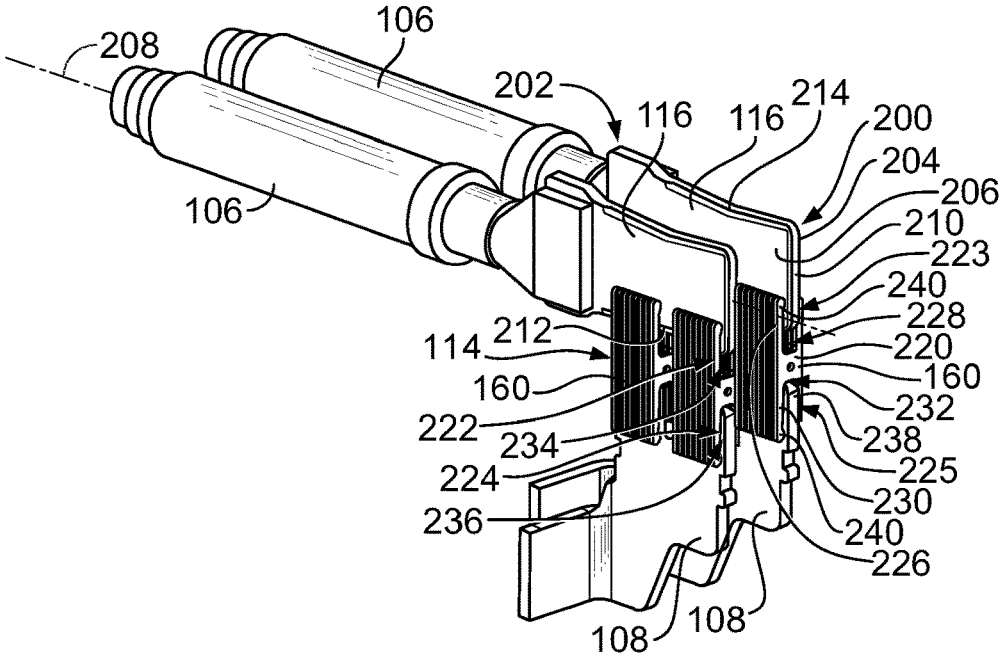
FIG. 4 is a perspective view of a portion of the power connector system showing the plug terminals and the header terminals.

FIG. 3 is a perspective view of a portion of the power connector system 100 showing the plug terminals 116 and the header terminals 114. FIG. 4 is a perspective view of a portion of the power connector system 100 showing the plug terminals 116 and the header terminals 114. The header housing 120 and the plug housing 130 are removed to illustrate the plug terminals 116 and the header terminals 114.

The plug terminals 116 are terminated to the power cables 106. For example, the plug terminals 116 may be welded to the power cables 106. The plug terminal 116 may be terminated to the power cable 106 by other means in alternative embodiment, such as crimping. In the illustrated embodiment, the plug terminals 116 are tab terminals that include tab or blade section. The plug terminals 116 are referred to hereinafter as tab terminals 116. Each tab terminal 116 is generally planar (at least along the tab or blade section) and extends between a mating end 200 and a cable end 202.

The tab terminal 116 includes first and second sides 204, 206 extending along a longitudinal axis 208 between a tip 210 of the tab terminal 116 and the cable end 202. The tab terminal 116 includes a leading edge 212 and a trailing edge 214 at the bottom and top, respectively, of the tab terminal 116. The leading edge 212 is the edge of the tab terminal 116 that is plugged into one or more of the header terminals 114.

The header terminals 114 are configured to be electrically connected to the tab terminals 116. In an exemplary embodiment, the header terminals 114 are also electrically connected to the power busses 108 of the header connector 102 (shown in FIG. 2). However, in alternative embodiments, the header terminals 114 may be integral with the power busses 108. In the illustrated embodiment, the header terminals 114 are double-ended fork terminals and may be referred to hereinafter as fork terminals 114.

Each of the header terminals 114 includes a series of contact members 160 disposed side-by-side in a stacked arrangement. Each contact member 160 includes a main body 220 between a first mating end 222 and a second mating end 224. The contact members 160 each include a pair of spring beams 226 defining a socket 228 at the first mating end 222 and a pair of spring beams 230 defining a socket 232 at the second mating end 224. When the contact members 160 are stacked together to define the header terminal 114, the sockets 228 of the contact members 160 align within the header terminal 114 to define a tab socket 234 at the first mating end 222. The tab socket 234 at the first mating end 222 is configured to receive the leading edge 212 of the tab terminal 116. Similarly, the sockets 232 of the individual contact members 160 align within the header terminal 114 to define a bus bar socket 236 at the second mating end 224 that is configured to receive a mating end 238 of the corresponding power bus 108. In the illustrated embodiment, the spring beams 226 of the contact members 160 in each header terminal 114 define a first fork contact 223 at the first mating end 222, and the spring beams 230 of the contact members 160 define a second fork contact 225 at the second mating end 224.

The spring beams 226, 230 are deflectable to receive the tab terminal 116 and the power bus 108, respectively. When mated, the spring beams 226, 230 are spring biased against the tab terminal 116 and the power bus 108, respectively. The spring beams 226 are arranged on both sides of the socket 228 to engage the first and second sides 204, 206 of the tab terminal 116.

In an exemplary embodiment, each spring beam 226 defines a mating interface 240 at or near a distal end of the spring beam 226. The mating interfaces 240 may be defined by bumps or protrusions at the distal ends of the spring beams 226. In an exemplary embodiment, each fork contact 223, which is defined by multiple spring beams 226 stacked together, includes multiple points of contact with the tab terminal 116. For example, each mating interface 240 on a spring beam 226 in the stack defines a different point of contact with the tab terminal 116. Providing multiple contact members 160 in each header terminal 114 results in multiple points of contact between the tab terminal 116 and the header connector 102.

The fork contacts 225 at the second mating end 224 (for example, the power bus mating side) of each header terminal 114 provides multiple points of contact with the power bus 108. For example, each spring beam 230 defines a mating interface 240 at or near a distal end of the spring beam 230. The mating interfaces 240 of the multiple spring beams 230 in the stack define different points of contact with the power bus 108. Providing multiple contact members 160 in each header terminal 114 results in multiple points of contact between the power bus 108 and the header connector 102. Increasing the number of contact members 160 in each header terminal 114 and/or increasing the number of header terminals 114 increases the amount of current carrying capacity of the header connector 102.

Optionally, the fork contacts 223, 225 of a single header terminal 114 may be identical, with the tab terminal 116 configured to plug into the tab socket 234 and the power bus 108 configured to plug into the bus bar socket 236. The header terminals 114 are easily manufactured and assembled. For example, the contract members 160 may be stamped and formed and any number of the contact members 160 may be arranged together within each of the header terminals 114.

Figure 5:
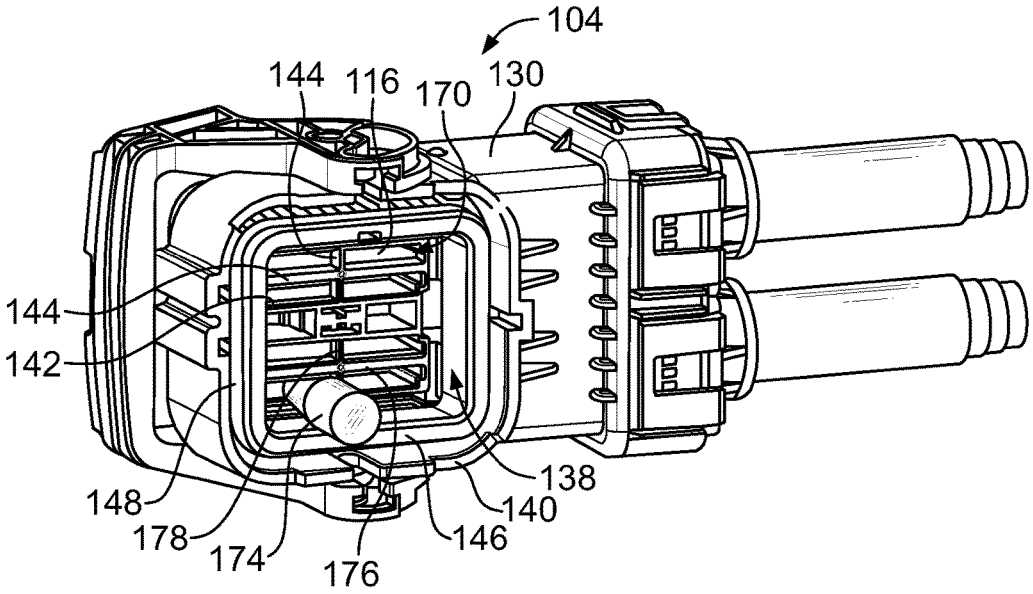
FIG. 5 is a bottom perspective view of the plug connector in accordance with an exemplary embodiment.
Figure 6:
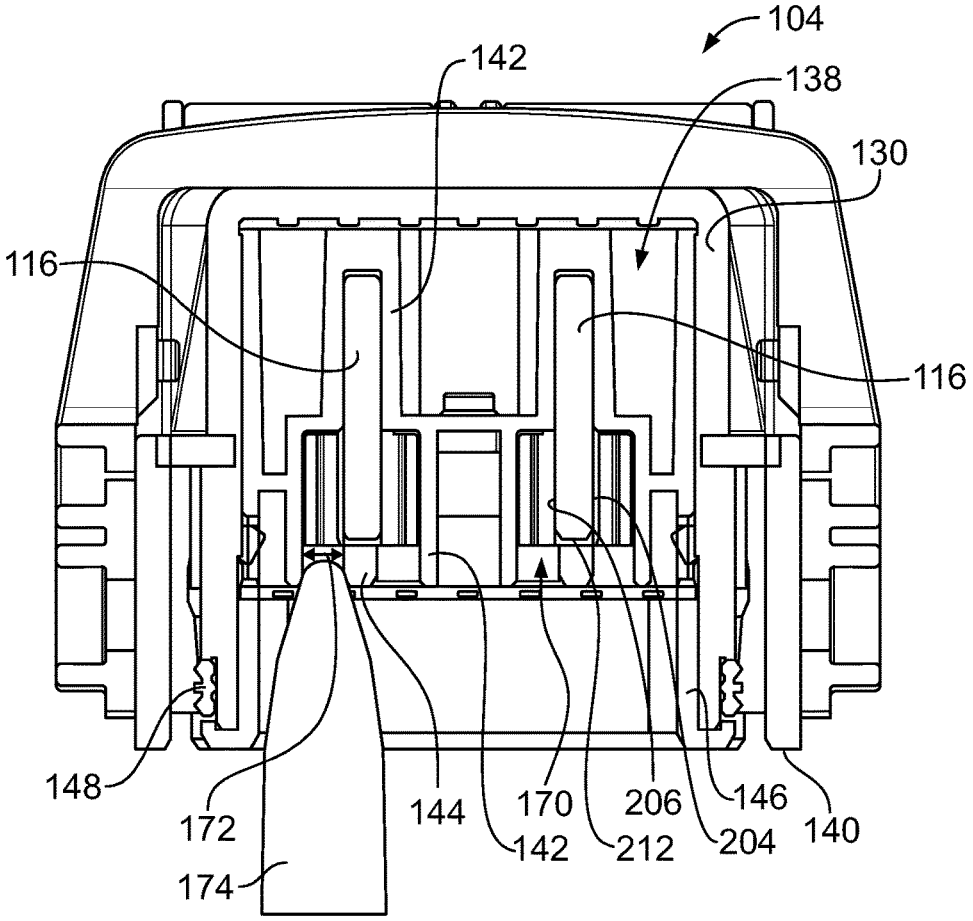
FIG. 6 is a sectional view of the plug connector.

FIG. 5 is a bottom perspective view of the plug connector 104 in accordance with an exemplary embodiment. FIG. 6 is a sectional view of the plug connector 104. The plug housing 130 holds multiple tab terminals 116 in a plug chamber 138. The plug chamber 138 is open at a bottom 140 of the plug housing 130 to expose the tab terminals 116. Portions of the header connector 102 (shown in FIG. 2) may be received in the plug chamber 138 through the bottom 140. For example, the header terminals 114 (shown in FIG. 2) may be received in the plug chamber 138 for electrical connection with the tab terminals 116. The plug housing 130 includes terminal support walls 142 supporting the tab terminals 116.

In an exemplary embodiment, the plug connector 104 includes plug covers or touch guards 144 such that the tab terminals 116 are touch-safe. For example, the plug touch guards 144 (also referred to herein simply as touch guards 144) may be bridges or beams spanning across the bottom of the tab terminals 116. The plug touch guards 144 are made from a dielectric material, such as plastic. The plug touch guards 144 are positioned relative to portions of the plug housing 130 such that gaps or spaces are small enough to be touch-safe.

In an exemplary embodiment the plug connector 104 includes a shield 146 to provide electrical shielding for the plug connector 104. Optionally, the shield 146 may be at least partially positioned in the plug chamber 138 such that the shield 146 surrounds the plug chamber 138 and/or the tab terminals 116. The shield 146 may be electrically connected to the electrical shielding of the power cables 106. The shield 146 may be configured to be electrically connected to the header connector 102. Optionally, the plug connector 104 may include a seal 148 in or around the plug chamber 138. The seal 148 may engage the header connector 102 to provide an environmental seal between the plug connector 104 and the header connector 102.

The terminals support walls 142 define terminal cavities 170 (FIG. 6) that receive the tab terminals 116. At the bottom of the terminal cavities 170, the terminal support walls 142 are spaced apart from the tab terminals 116. For example, space within a corresponding terminal cavity 170 is provided along both the first and second sides 204, 206 of the tab terminal 116 that is within the terminal cavity 170 near the leading edge 212. The first and second sides 204, 206 of the tab terminal 116 are exposed inside the plug chamber 138, such as in the terminal cavities 170. The terminal cavity 170 is sized to receive a portion of the header connector 102 in the spaces along the sides 204, 206 of the tab terminal 116. For example, the header terminals 114 of the header connector 102 may be received in the terminal cavity 170 to engage the first and second sides 204, 206 of the tab terminal 116.

In an exemplary embodiment, the plug touch guards 144 are provided at the bottom of the terminal cavity 170. For example, the plug touch guards 144 are provided outward of (for example, below, the leading edge 212). Optionally, the plug touch guards 144 may be integral with the terminal support walls 142. Alternatively, the touch guards 144 may be separate pieces from the terminal support walls 142 and loaded into the terminal cavity 170 where the touch guards 144 are coupled to the terminal support walls 142. The touch guards 144 are spaced apart from the terminal support walls 142 by a spacing 172. The width of the spacing 172 is narrow enough to make the plug connector 104 touch-safe. For example, the spacing 172 may be narrow enough that a test probe 174 is unable to touch the tab terminal 116. Thus, no portion of the power circuit is able to be touched by a user, making the plug connector 104 touch-safe.

In the illustrated embodiment, the plug touch guard 144 includes a longitudinal member 176 extending longitudinally along and directly below the tab terminal 116. Depending on the length of the longitudinal member 176, the touch guard 144 may include one or more lateral members 178 to strengthen or support the longitudinal member 176. In the illustrated embodiment, the lateral members 178 extend perpendicular to the longitudinal members 176. The lateral members 178 extend between the longitudinal members 176 and the terminal support walls 142. The lateral members 178 strengthen and support the longitudinal member 176. For example, the longitudinal member 176 is unable to be pushed side-to-side a sufficient amount of distance to change the spacing 172 such that the plug connector 104 fails the touch-safe test.

Figure 7:
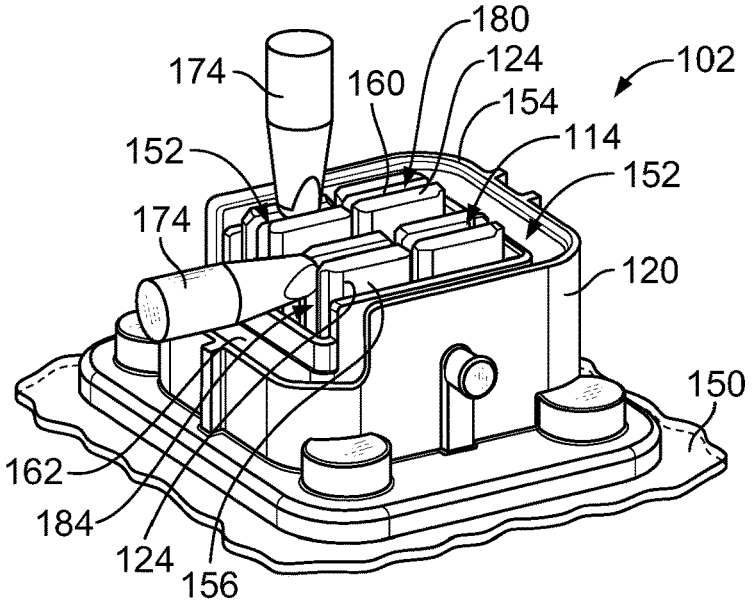
FIG. 7 is a perspective view of the header connector in accordance with an exemplary embodiment.
Figure 8:
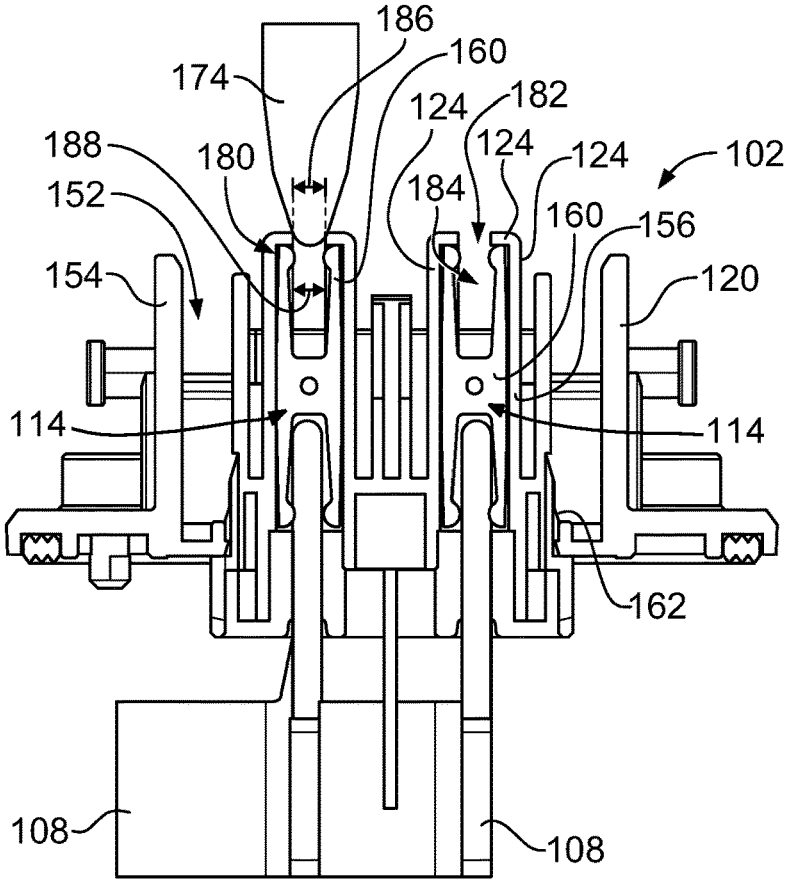
FIG. 8 is a cross-sectional view of the header connector.
Figure 9:
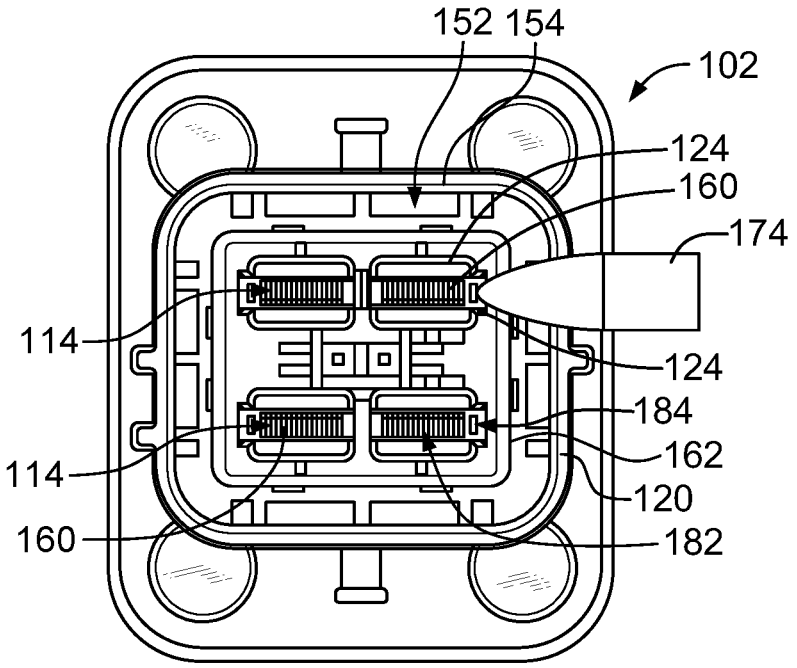
FIG. 9 is a top view of the header connector.

FIG. 7 is a perspective view of the header connector 102 in accordance with an exemplary embodiment. FIG. 8 is a cross-sectional view of the header connector 102. FIG. 9 is a top view of the header connector 102. The header connector 102 is configured to be mounted to a chassis 150 or other supporting structure. Optionally, the header connector 102 may be electrically grounded to the chassis 150. The header housing 120 defines a header chamber 152 configured to receive a portion of the plug connector 104 (shown in FIG. 2). For example, the header chamber 152 may be defined by shroud walls 154 of the header housing 120.

The header terminals 114 are supported by the header housing 120. The header terminals 114 may be held by terminal support walls 156. The terminals support walls 156 may define the header touch guards 124 to make the header connector 102 touch-safe. For example, the terminal support walls 156 may be provided along sides and/or ends of the header terminals 114.

In an exemplary embodiment, the header terminals 114 are each defined by a stacked arrangement of the contact members 160. Optionally, the header connector 102 includes multiple header terminals 114. The header terminals 114 may define different circuits or may be part of common circuits. For example, two header terminals 114 configured to electrically connect to the same tab terminal 116 may be part of a common circuit, and header terminals 114 that are configured to mate to different tab terminals 116 may define different circuits. Optionally, providing multiple header terminals 114 increases the current carrying capability or capacity of the header connector 102. The header connector 102 includes four header terminals 114 in the FIG. 7, but may include fewer or more header terminals 114 in other embodiments.

In an exemplary embodiment, the header connector 102 includes a shield 162 held by the header housing 120. The shield 162 provides electrical shielding for the header terminals 114. The shield 162 is provided in the header chamber 152 and may extend to the bottom of the header connector 102 to electrically connect with the chassis 150. For example, the shield 162 may be grounded to the chassis 150.

FIG. 8 illustrates the header terminals 114 held in the header housing 120 by the terminal support walls 156. The terminal support walls 156 define terminal cavities 180 that hold the header terminals 114 (e.g., the contact members 160 that define each of the header terminals 114). The power bus 108 extends into the bottom of the terminal cavity 180 to engage the bottom mating ends of the header terminals 114. The terminal support walls 156 extend along both sides of each header terminal 114 to the top mating end of the header terminal 114. The terminal support walls 156 define the header touch guards 124 along the sides of the header terminals 114. The header touch guards 124 also extend along the tops of the header terminals 114.

The header housing 120 defines a top opening 182 and side openings 184 that provide access to the terminal cavity 180. The header touch guard 124 is provided at the top opening 182 to prevent inadvertent touching of the header terminals 114. The header touch guard 124 is provided at the sides along the side openings 184 to prevent inadvertent touching of the header terminals 114. The top opening 182 and the side openings 184 have spacings 186, 188, respectively. Optionally, the spacings 186, 188 may be the same. However, the spacings 186, 188 may be different in alternative embodiments. The spacings 186, 188 are narrow enough to ensure that the test probe 174 is unable to engage the header terminal 114, making the header connector 102 touch-safe.

Figure 10:
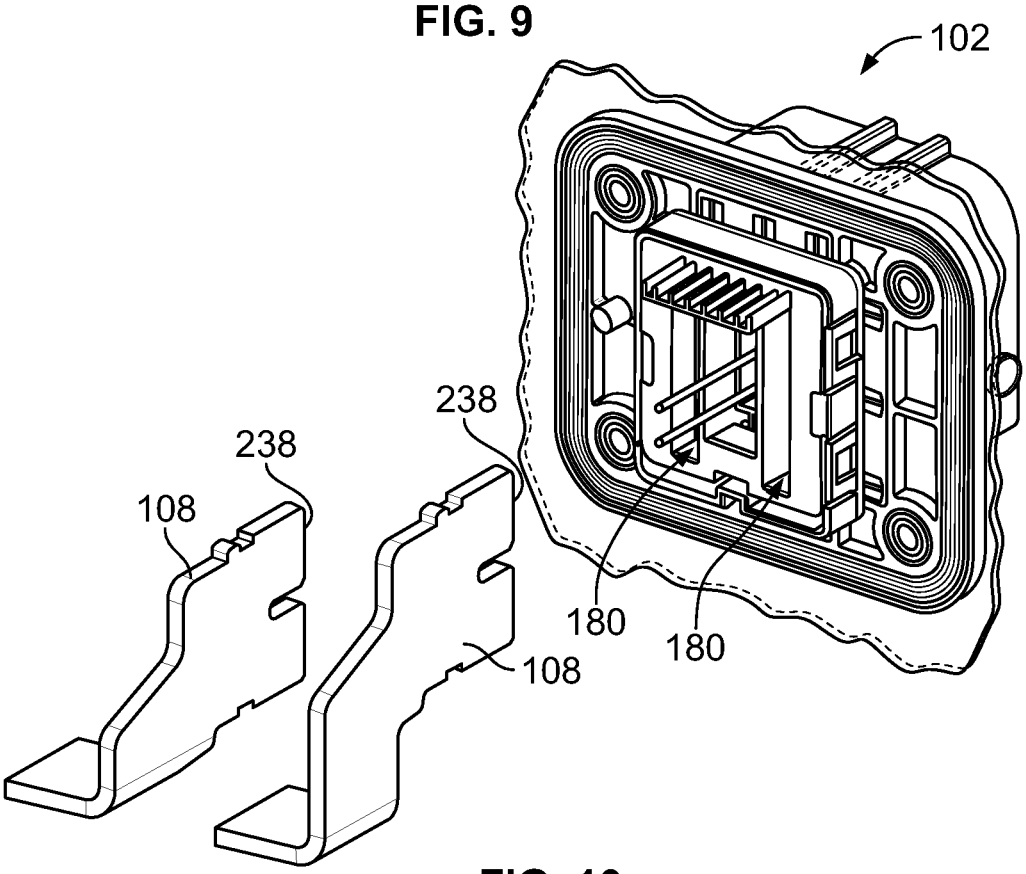
FIG. 10 is a bottom perspective view of the header connector showing power busses poised for coupling to the header terminals.

FIG. 10 is a bottom perspective view of the header connector 102 showing the power busses 108 poised for coupling to the header terminals 114 (shown in FIG. 8). The terminal cavities 180 may be open at the bottom to receive the mating ends 238 of the power busses 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power connector system comprising:

a header connector having a header housing mounted to a chassis, the header housing having a mating end, the header connector including a header terminal held by the header housing at the mating end of the header housing, the header terminal comprising a plurality of contact members arranged side-by-side in a stacked arrangement, each contact member having a pair of spring beams defining a socket at a mating end of the contact member, the sockets of the contact members being aligned to define a tab socket of the header terminal exposed at the mating end of the header housing; and a plug connector having a plug housing having a mating end mated to the mating end of the header housing, the plug connector including a tab terminal held at the mating end of the plug housing, the tab terminal having a cable end and a mating end, the mating end being received in a mating direction into the tab socket of the header terminal during mating to directly mate to the header terminal and to electrically connect the tab terminal with the header terminal.

2. The power connector system of claim 1, wherein the tab terminal is a solid piece of metal terminated to a power cable at the cable end, the tab terminal having a first side and a second side, the tab terminal also having an edge at the mating end, the edge being loaded into the tab socket of the header terminal during mating.

3. The power connector system of claim 1, wherein the header terminal has multiple points of contact with the tab terminal.

4. The power connector system of claim 1, wherein the plug connector includes a lever connected to the housing, the lever engaging the header connector, wherein the plug connector is moved relative to the header connector when the lever is actuated to mate and unmate the plug connector and the header connector.

5. The power connector system of claim 1, wherein the spring beams of the contact members are deflectable against the tab terminal when mated thereto.

6. The power connector system of claim 1, wherein each of the contact members defines a fork contact at the mating end.

7. The power connector system of claim 6, wherein the mating end of the contact member is a first contact member and each of the contact members defines a fork contact at a second mating end opposite the first mating end, the fork contact at the second mating end defining a socket configured to receive a bus bar therein.

8. The power connector system of claim 1, wherein the header connector includes a header touch guard to make the header connector touch-safe, and the plug connector includes a plug touch guard to make the plug connector touch-safe.

9. A power connector system comprising:

a header connector having a header housing mounted to a chassis, the header housing defining a header chamber, the header housing having a mating end, the header connector including a plurality of contact members held in the header chamber at the mating end of the header housing, the contact members being arranged side-by-side in a stacked arrangement to define a header terminal, the contact members each having a pair of spring beams defining a socket at a mating end of the respective contact member, the sockets of the contact members being aligned to define a tab socket of the header terminal, the header connector including a header touch guard around the header terminal, the header touch guard having openings that provide mating access to the header terminal but are touch-safe; and a plug connector having a plug housing defining a plug chamber, the plug housing having a mating end mated to the mating end of the header housing and a cable end with a power cable extending from the cable end, the plug connector holding a tab terminal in the plug chamber at the mating end of the plug housing, the tab terminal having a mating end being received in a mating direction into the tab socket of the header terminal during mating to directly mate to the contact members of the header terminal and to electrically connect the tab terminal with each of the contact members in the header terminal, the tab terminal having a cable end that is terminated to the power cable, the plug connector having a plug touch guard at the mating end of the plug housing that provides mating access to the tab terminal but is touch-safe.

10. The power connector system of claim 9, wherein the header touch guard surrounds a top, sides, and edges of the header terminal.

11. The power connector system of claim 9, wherein the plug touch guard covers the mating end of the tab terminal and is received in the tab socket of the header terminal during mating.

12. The power connector system of claim 9, wherein the plug touch guard covers the mating end of the tab terminal, the tab terminal having opposite first and second sides that are exposed inside the plug chamber, the spring beams of the contact members in the header terminal engaging the first and second sides of the tab terminal inside the plug chamber during mating.

13. The power connector system of claim 9, wherein the tab terminal is a solid piece of metal terminated to the power cable, the tab terminal having a first side and an opposite, second side, the tab terminal also having an edge at the mating end of the tab terminal, the edge being loaded into the tab socket of the header terminal during mating.

14. The power connector system of claim 9, wherein the header terminal has multiple points of contact with the tab terminal.

15. The power connector system of claim 9, wherein the plug connector includes a lever connected to the housing, the lever engaging the header connector, wherein the plug connector is moved relative to the header connector when the lever is actuated to mate and unmate the plug connector and the header connector.

16. The power connector system of claim 9, wherein the spring beams of the contact members are deflectable against the tab terminal when mated thereto.

17. The power connector system of claim 9, wherein each of the contact members defines a fork contact at the mating end of the respective contact member.

18. A power connector system comprising:

a header connector having a header housing mounted to a chassis, the header housing having a mating end, the header connector including a plurality of contact members arranged side-by-side in a stacked arrangement to define a header terminal at the mating end of the header housing, the contact members being double-ended fork contacts having pairs of spring beams that define sockets at both a first mating end and a second mating end of the respective contact member, the sockets at the first mating ends of the contact members being aligned to define a tab socket of the header terminal, the sockets at the second mating ends of the contact members being aligned to define a bus bar socket of the header terminal configured to receive a bus bar therein; and a plug connector having a plug housing having a mating end mated to the mating end of the header housing, the plug connector including a tab terminal held at the mating end of the plug housing, the plug housing having a mating end and a cable end with a power cable extending from the cable end, the tab terminal having a mating end being received in a mating direction into the tab socket of the header terminal during mating to directly mate to the contact members of the header terminal and to electrically connect the tab terminal with each of the contact members in the header terminal, the tab terminal having a cable end terminated to the power cable.

19. The power connector system of claim 18, wherein the tab terminal is a solid piece of metal having a first side and an opposite, second side, the tab terminal also having an edge that extends between the first and second sides at the mating end, the edge being loaded into the tab socket of the header terminal during mating.

20. The power connector system of claim 18, wherein the spring beams of the contact members are deflectable against the tab terminal when mated thereto.

* * * * *